US006396015B1

(12) United States Patent
Ko

(10) Patent No.: US 6,396,015 B1
(45) Date of Patent: May 28, 2002

(54) THREE-STEP PRESS SWITCH

(76) Inventor: Kent Ko, No. 342, Ta Tung Road, Koei Shan Hsiang, TaoYuan Hsien (TW)

( * ) Notice: Subject to any disclaimer, the term of this patent is extended or adjusted under 35 U.S.C. 154(b) by 0 days.

(21) Appl. No.: 09/859,380

(22) Filed: May 18, 2001

(51) Int. Cl.[7] ..... H01H 3/02
(52) U.S. Cl. ..... 200/529; 200/527
(58) Field of Search ..... 200/529, 4, 11 A, 200/11 J, 11 R, 341, 520, 533, 534, 536, 527, 565, 566, 568

(56) References Cited

U.S. PATENT DOCUMENTS 4,293,751 A * 10/1981 Van Benthuysen et al. . 200/156
5,049,709 A * 9/1991 Prickett et al. ..... 200/527
5,226,529 A * 7/1993 Valenzona ..... 200/529
5,586,645 A * 12/1996 Bartok ..... 200/527

FOREIGN PATENT DOCUMENTS

EP 341901 A1 * 11/1989

* cited by examiner

*Primary Examiner*—P. Austin Bradley
*Assistant Examiner*—Lisa N Klaus
(74) *Attorney, Agent, or Firm*—Rosenberg, Klein & Lee

(57) ABSTRACT

A three-step switch includes a casing defining a first receiving chamber and a second receiving chamber, an actuating device mounted in the first receiving chamber, three metal contact plates and a metal conducting plate mounted in the second receiving chamber, the actuating device being forced to rotate the metal conducting plate through a predetermined angle relative to the metal contact plates when pressed, to further achieve a three-step switching operation.

1 Claim, 6 Drawing Sheets

THREE-STEP PRESS SWITCH

BACKGROUND OF THE INVENTION a. Field of the Invention

The present invention relates to a three-step switch and, more particularly, to a three-step press switch, which achieves a three-step switching operation when continuously pressed at different times.

b. Description of the Prior Art

A variety of electric switches including sliding switches, rotary switches, press switches, and etc., have been disclosed for use with electric apparatus. Regular electric switches are commonly of two-step type adapted to switch on/off the power circuit of an electric apparatus. For an electric apparatus having two power circuits, two switches must be used. However, the use of multiple switches greatly increases the cost of the electric apparatus, and requires much installation space. Taiwan Patent publication no. 275966 discloses an improved structure of three-step switch, which, as shown in FIG. 1, is a sliding switch comprised of a housing 11, a slide 12 mounted in the housing 11, and a movable metal contact plate 13 moved with the slide 12 to one of three positions, namely, the first position where the movable metal contact plate 13 contacts the first fixed metal contact plate A to close the first circuit, a second position where the movable metal contact plate 13 is disconnected from the first fixed metal contact plate A and the second fixed metal contact plate B to open the first circuit and the second circuit, and a third position where the movable metal contact plate 13 contacts the second fixed metal contact plate B to close the second circuit. Taiwan patent no. 409932 discloses a three-step lamp switch, which, as shown in FIG. 2, is a rotary switch comprised of a housing 14, a rotary knob 15, and a metal contact plate 16 rotated with the rotary knob 15 to alternatively touch the first fixed metal contact plate 17 or the second fixed metal contact plate (not shown), or not to touch the first fixed metal contact plate and the second fixed metal contact plate. According to the aforesaid two three-step switch designs, the slide 12 or the rotary knob 15 are exposed to the outside of the housing 11 or 14 for operation by hand. However, these two designs cannot be covered with waterproof cover means to protect against outside water. When adding waterproof cover means to housing, the waterproof cover means may hinder the movement of the slide or rotary knob.

Further, regular two-step press switch, for example, the press-button switch of an automatic pen can be covered with a waterproof covering to protect the internal circuit against outside water. However, this design of press switch can be switched between two positions(ON<–>OFF) only, its application is limited.

SUMMARY OF THE INVENTION

The present invention has been accomplished under the circumstances in view. It is the main object of the present invention to provide a three-step switch, which achieves three-step switching operation by pressing. It is another object of the present invention to provide a three-step press switch, which is inexpensive to manufacture. It is still another object of the present invention to provide a three-step press switch, which requires less installation space. It is still another object of the present invention to provide a three-step switch, which is suitable for use in a waterproof product. To achieve these and other objects of the present invention, the three-step press switch is comprised of a casing shaped like a stepped tube, said casing comprising a first receiving chamber and a second receiving chamber, said first receiving chamber comprising a plurality of longitudinal guide grooves equiangularly spaced around an inside wall thereof, said longitudinal guide grooves each having a beveled bottom side, an outer thread around the periphery of an upper part thereof, and a flange extended around the periphery of a middle part thereof; an actuating device mounted in the first receiving chamber of the casing and forced to rotate through an angle when pressed, the actuating device comprised of a press member, a rotary member, and a spring, the press member being a hollow, bottom-open shell, comprising a plurality of longitudinal ribs spaced around the periphery of a lower part thereof and respectively coupled to the longitudinal guide grooves of the casing to guide vertical movement of the press member in the casing and a downwardly extended serrated bottom edge, the rotary member being a hollow, bottom-open shell, comprising a top insertion portion inserted into the press member from a bottom side, an upwardly extended serrated portion disposed around the periphery thereof on the middle and meshed with the serrated bottom edge of the press member, the spring of the actuating device being mounted in the rotary member to impart an upward pressure to the rotary member and the press member; wherein the second receiving chamber of the casing comprises a plurality of three openings in the periphery thereof, three downward pins respectively suspending in the openings, a first metal contact plate coupled to one of the downward pins and disposed at one side of the casing, a second metal contact plate and a third metal contact plates disposed at one side of the casing opposite to the first metal contact plate and arranged at right angles; the rotary member comprises two downwardly extended driving rods adapted to rotate a metal conducting member below; the three-step press switch further comprises a bottom cover covered on a bottom side of the casing, a second spring mounted in the bottom cover, and a metal conducting member supported on the second spring and coupled to the rotary member for synchronous rotation with the rotary member relative to one of a series of positions including a first position where the first metal contact plate and the second metal contact plate and the third metal contact plate are electrically disconnected, a second position where the metal conducting plate is disposed in contact with the first metal contact plate and the second metal contact plate to electrically connect the first metal contact plate and the second metal contact plate, and a third position where the metal conducting plate is disposed in contact with the first metal contact plate and the third metal contact plate to electrically connect the first metal contact plate and the third metal contact plate, the metal conducting plate comprising a flat base supported on the second spring and an upright rod upwardly extended from the center of the flat base and inserted into the rotary member from a bottom side, the flat base comprising two peripheral lugs disposed at two sides and adapted to contact the first metal contact plate, the second metal contact plate and the third metal contact plate, and two peripheral notches respectively coupled to the downwardly extended driving rods of the rotary member for enabling the metal conducting member to be rotated with the rotary member when the press member is pressed by an external force.

DETAILED DESCRIPTION OF THE PREFERRED EMBODIMENT

Figure 1:
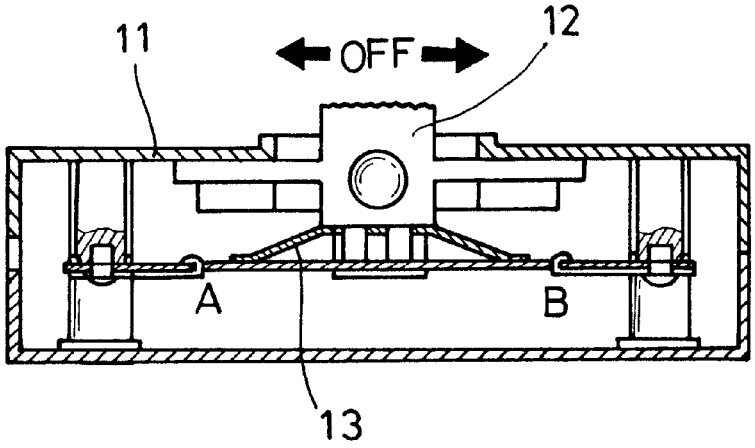
FIG. 1 PRIOR ART
FIG. 1 is a sectional view of a three-step sliding switch constructed according to the prior art.
Figure 2:
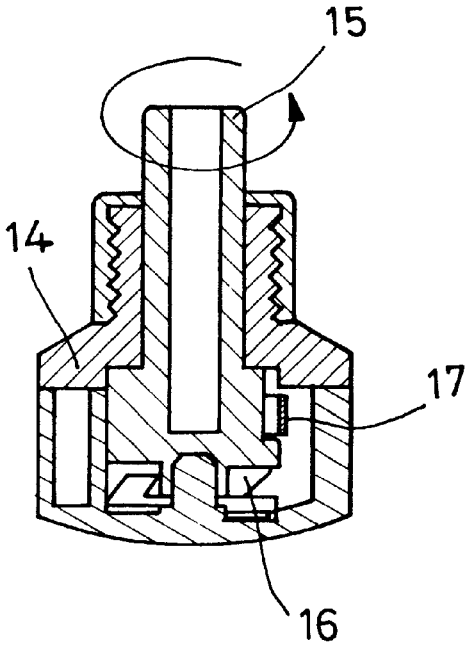
FIG. 2 PRIOR ART
FIG. 2 is a sectional view of a three-step rotary switch constructed according to the prior art.
Figure 4:
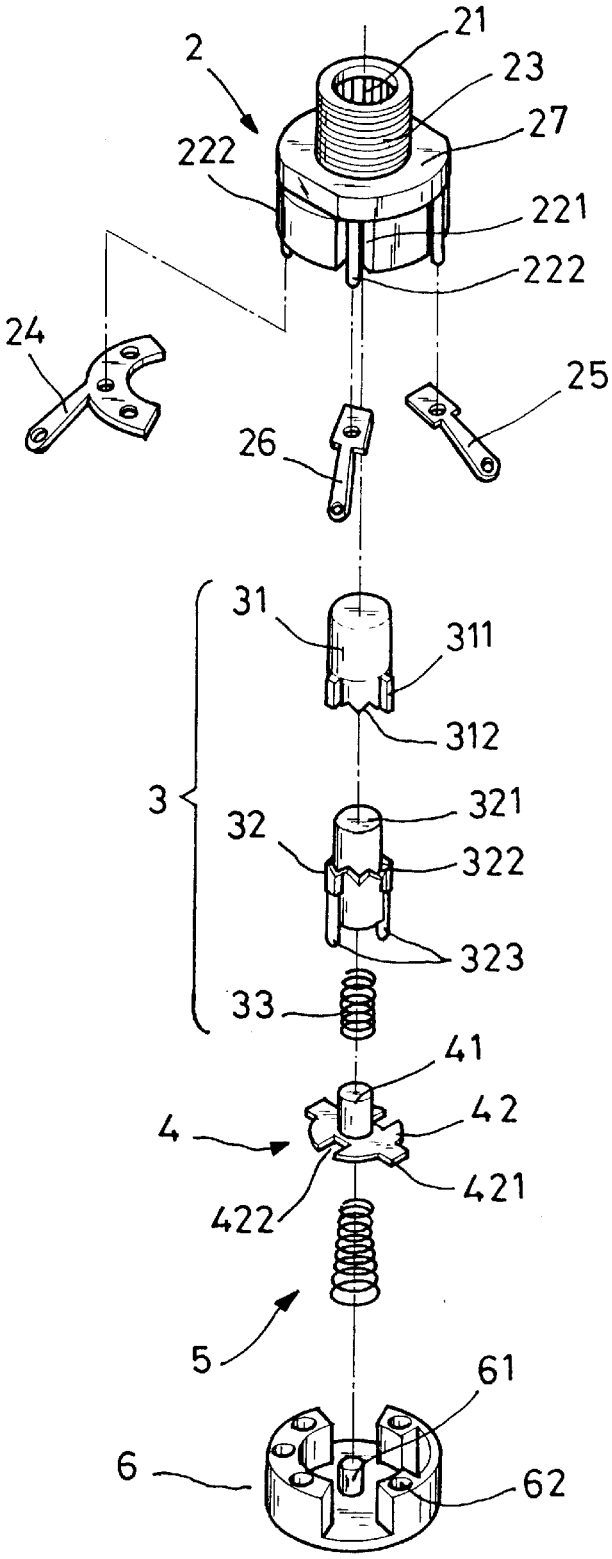
FIG. 4 is an exploded view of the three-step press switch according to the present invention.
Figure 3:
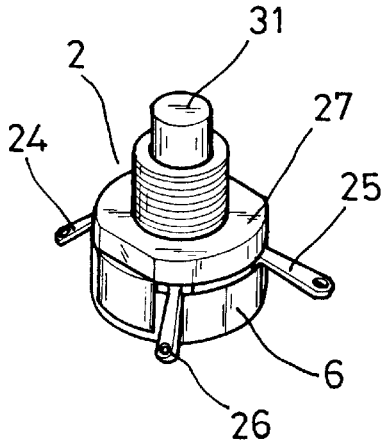
FIG. 3 is an elevational view of a three-step press switch constructed according to the present invention.
Figure 5:
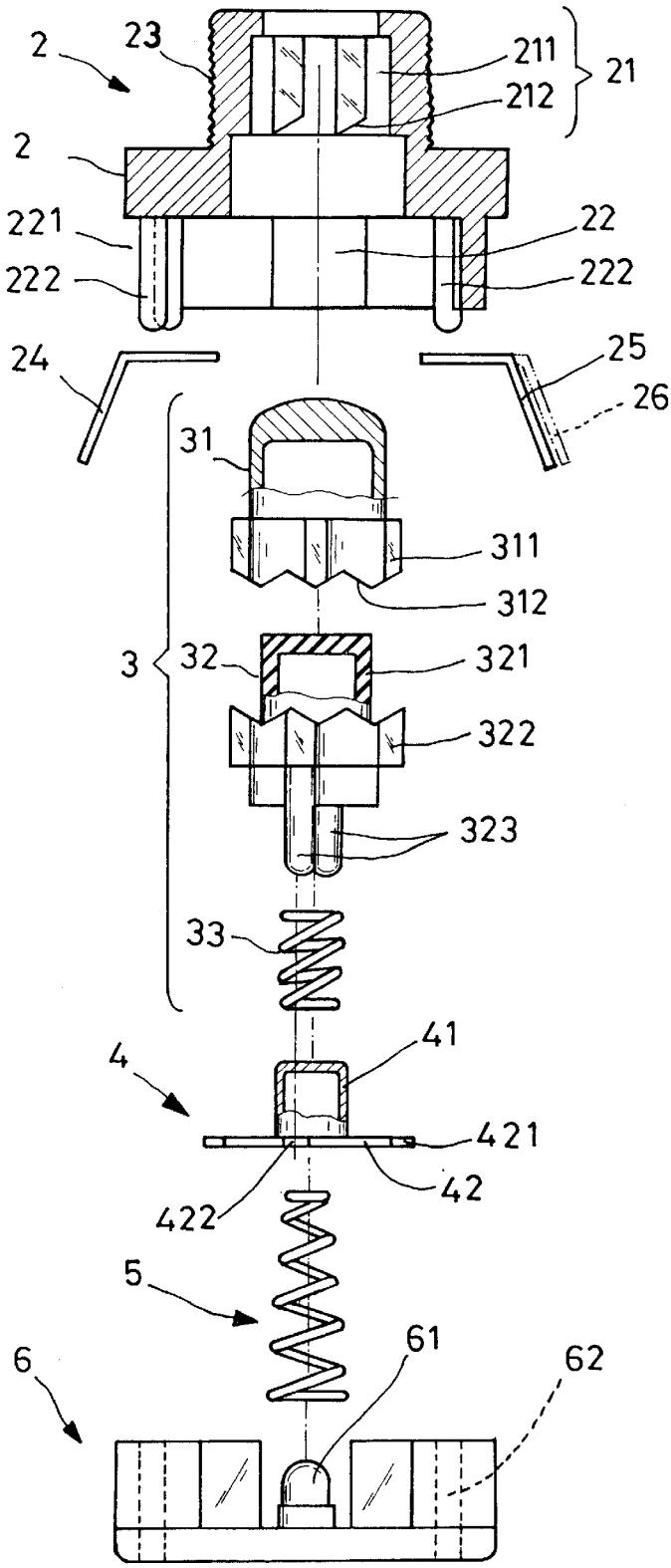
FIG. 5 is a sectional view in an enlarged scale of FIG. 4.

Referring to FIGS. from 3 through 6, a three-step press switch is shown comprising a casing 2, and an actuating device 3. The casing 2 is shaped like a stepped tube comprising a first receiving chamber 21 and a second receiving chamber 22. The first receiving chamber 21 comprises a plurality of longitudinal guide grooves 211 equiangularly spaced around the inside wall thereof Each longitudinal guide groove 211 has a beveled bottom side 212. The casing 2 further comprises an outer thread 23 around the periphery of the upper part thereof, and a flange 27 around the periphery of the middle part thereof. The actuating device 3 is mounted in the first receiving chamber and forced to rotate when pressed by an external force, comprising a press member 31, a rotary member 32, and a spring 33. The press member 31 is a hollow, bottom-open shell, comprising a plurality of longitudinal ribs 311 spaced around the periphery of the lower part thereof and respectively coupled to the longitudinal guide grooves 211 of the casing 2 to guide vertical movement of the press member 31 in the casing 2, and a downwardly extended serrated bottom edge 312. The rotary member 32 is a hollow, bottom-open shell, comprising a top insertion portion 321 inserted into the press member 31, an upwardly extended serrated portion 322 disposed on the middle around the periphery and meshed with the serrated bottom edge 312 of the press member 31. The spring 33 is mounted in the rotary member 32 to impart an upward pressure to the rotary member 31 and the press member 31.

The aforesaid arrangement is commonly seen in the prior art ON-OFF two-step press switches or automatic pencil press control devices. The main features of the present invention are outlined hereinafter.

The second receiving chamber 22 of the casing 2 comprises a plurality of three openings 221 in the peripheral wall, and three downward pins 222 respectively suspending in the openings 221. Three metal contact plates, namely, the first metal contact plate 24, the second metal contact plate 25 and the third metal contact plate 26 are respectively coupled to the downward pins 222. The first metal contact plate 24 has a relatively broader contact area, and is disposed at one side. The second metal contact plate 25 and the third metal contact plate 26 are disposed at one side opposite to the first metal contact plate 24, and arranged at right angles. The rotary member 32 comprises two downwardly extended driving rods 323 adapted to rotate a metal conducting member 4 below. The metal conducting member 4 comprises a flat base 42 supported on a spring 5, and an upright rod 41 upwardly extended from the center of the top sidewall of the flat base 42 and inserted into the rotary member 32. The flat base 42 comprises two peripheral lugs 421 disposed at two sides and adapted to contact the second metal contact plate 24 and the third metal contact plate 25 in the second receiving chamber 22 of the casing 2, and two peripheral notches 422 bilaterally equally spaced between the peripheral lugs 421 and respectively coupled to the downwardly extended driving rods 323 of the rotary member 32, for enabling the metal conducting member 4 to be rotated with the rotary member 32. The spring 5, the metal conducting member 4 and the actuating device 3 are held down in the casing 2 by a bottom cover 6 being covered on the bottom side of the casing 2. The bottom cover 6 comprises an upright center rod 61, which supports the spring 5, and a plurality of pinholes 62, which receive the downward pins 222 respectively.

When rotating the actuating device 3 through an angle, the metal conducting member 4 is synchronously rotated to force the peripheral lugs 421 into contact with the first metal contact plate 24 and the second metal contact plate 25 or third metal contact plate 26, or to move the peripheral lugs 421 away from the metal contact plates 24, 25, 26, so as to achieve a three-step switching operation.

Figure 6:
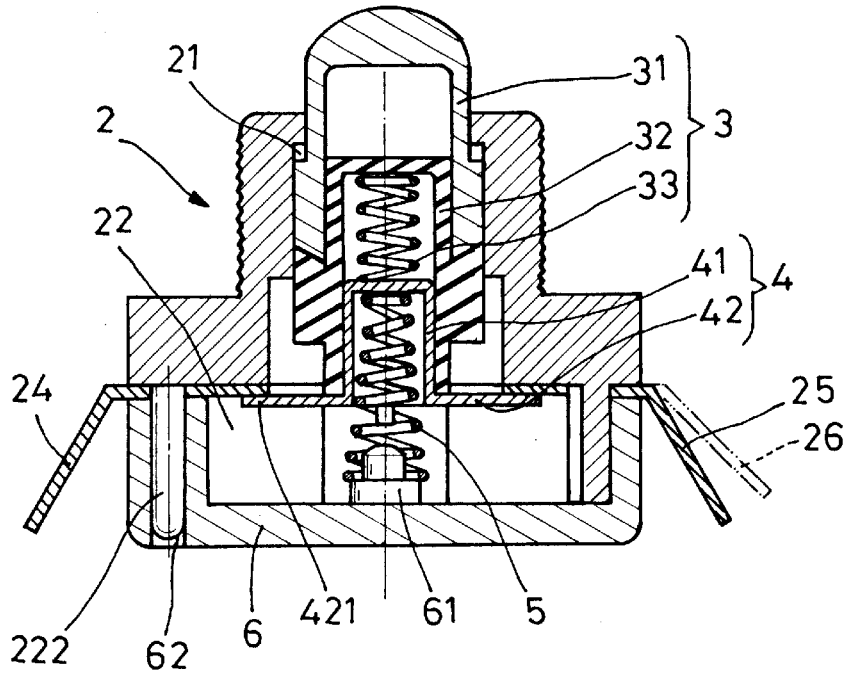
FIG. 6 is a side view in section in an enlarged scale of FIG. 3.
Figure 7:
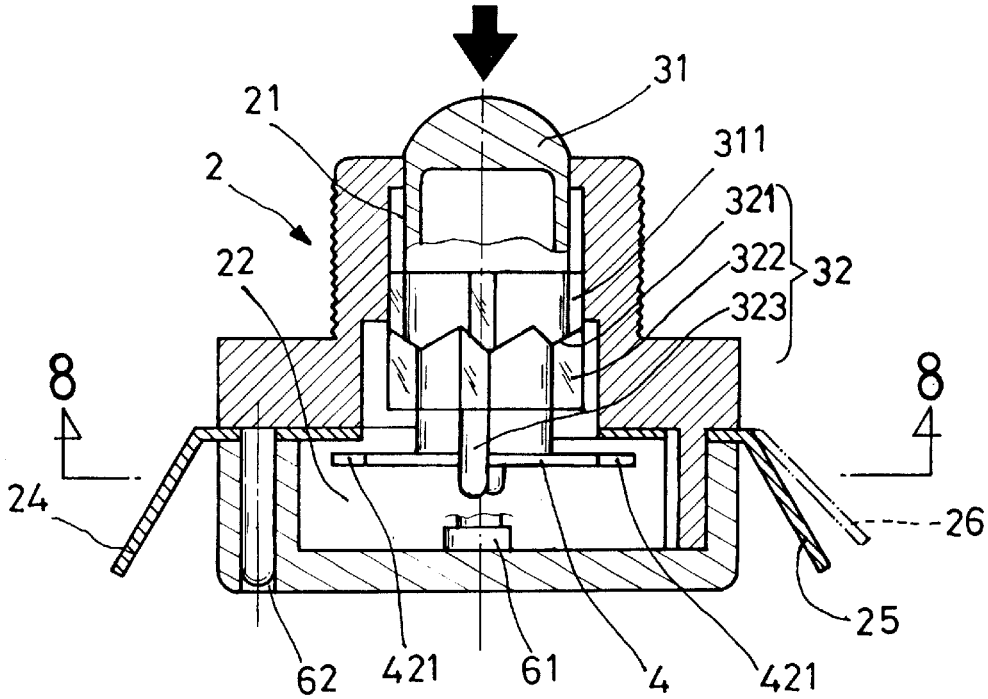
FIG. 7 is another sectional view of the present invention showing the press member pressed.
Figure 8:
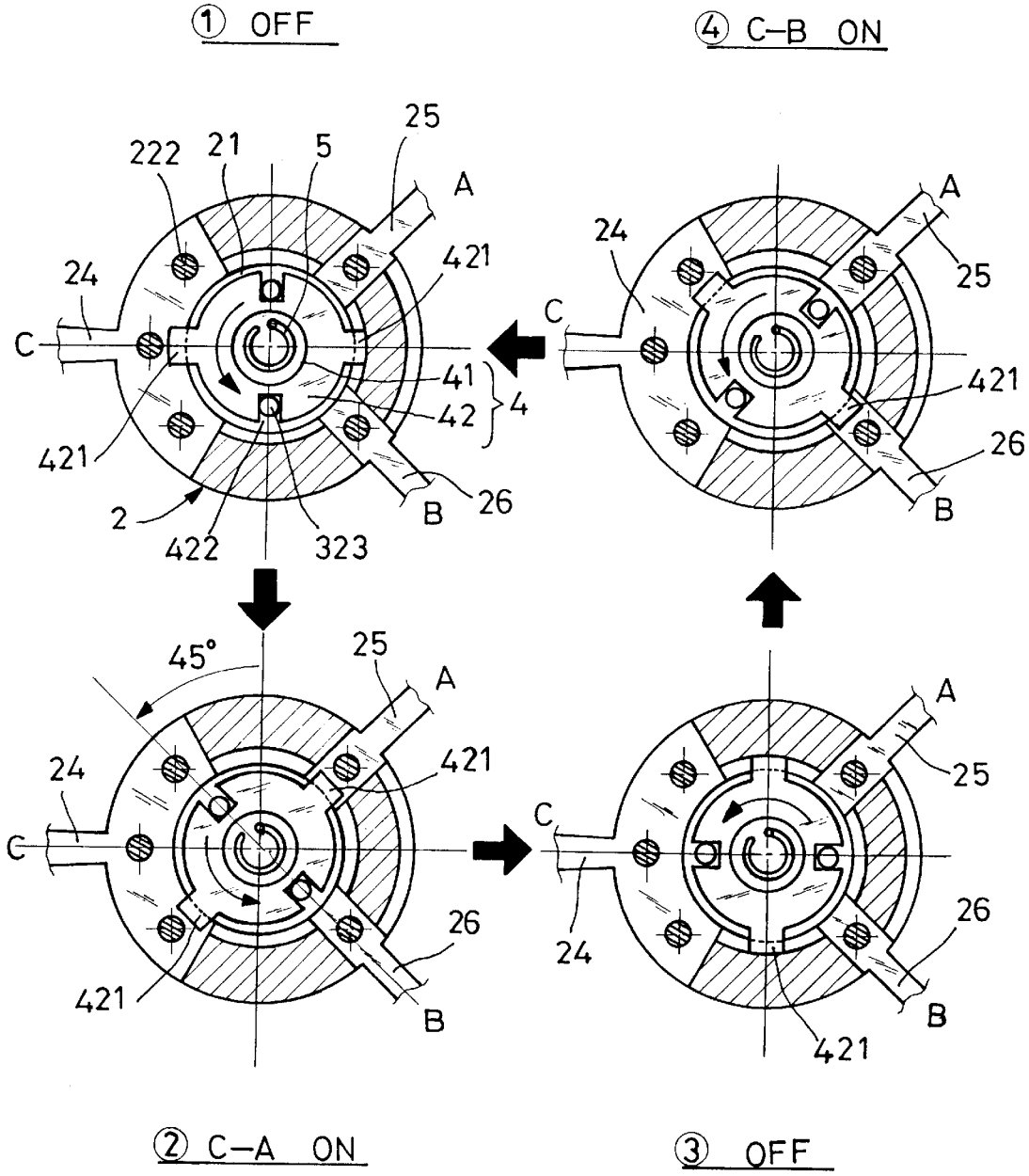
FIG. 8 illustrates the position change of the three-step press switch according to the present invention.

The operation of the present invention is outlined hereinafter with reference to FIGS. 6 and 7. When pressing the press member 31 of the actuating device 3 with the finger, the press member 31 is moved axially in the first receiving chamber 21 of the casing 2, and the rotary member 32 is driven to rotate through an angle (this part is of the known art, and no further detail description is needed). During rotary motion of the rotary member 32, the metal conducting member 4 is synchronously rotated. The rotary switching action of the metal conducting member 4 is performed in the order of (1)®(2)®(3)®(4) as illustrated in FIG. 8. FIG. 8-(1) shows the metal conducting plate 4 forced upwards against the rotary member 32 toward the first receiving chamber 21 of the casing 2 by the spring 5, one of the peripheral lugs 421 of the metal conducting plate 4 disposed in contact with the first metal contact plate 24 and the other of the peripheral lugs 421 of the metal conducting plate 4 pressed against the first receiving chamber 21 without contacting either of the metal contact plates 24;25;26, and therefore the metal contact plates 24;25;26 are electrically disconnected, i.e., the contacts A-B-C are off. When pressing the press member 31 once, the rotary member 32 and the metal conducting plate 4 are rotated through 45°. At this time, as shown in FIG. 8-(2), one of the peripheral lugs 421 of the metal conducting plate 4 is disposed in contact with the first metal contact plate 24, and the other of the peripheral lugs 421 of the metal conducting plate 4 is disposed in contact with the second metal contact plate 25, and therefore contacts C-A are electrically connected. When pressing the press member 31 again, the rotary member 32 and the metal conducting plate 4 are rotated further through another 45°. At this time, as shown in FIG. 8-(3), one of the peripheral lugs 421 of the metal conducting plate 4 are spaced from the metal contact plates 24;25;26, and therefore the contacts A-B-C are off. When pressing the press member 31 at the third time, the rotary member 32 and the metal conducting plate 4 are rotated again through further 45°. At this time, as shown in FIG. 8-(4), the peripheral lugs 421 of the metal conducting plate 4 are respectively disposed in contact with the first metal contact plate 24 and the third metal contact plate 26, and therefore the contacts C-B are electrically connected. When pressing the press member 31 again, the switch is returned to the position shown in FIG. 8-(1). Therefore, in each 180° rotation cycle (45°×4) of the metal conducting plate 4, three switching status, namely, OFF®C-A®OFF®C-B are shifted in proper order to achieve the designed three-step switching.

Figure 9:
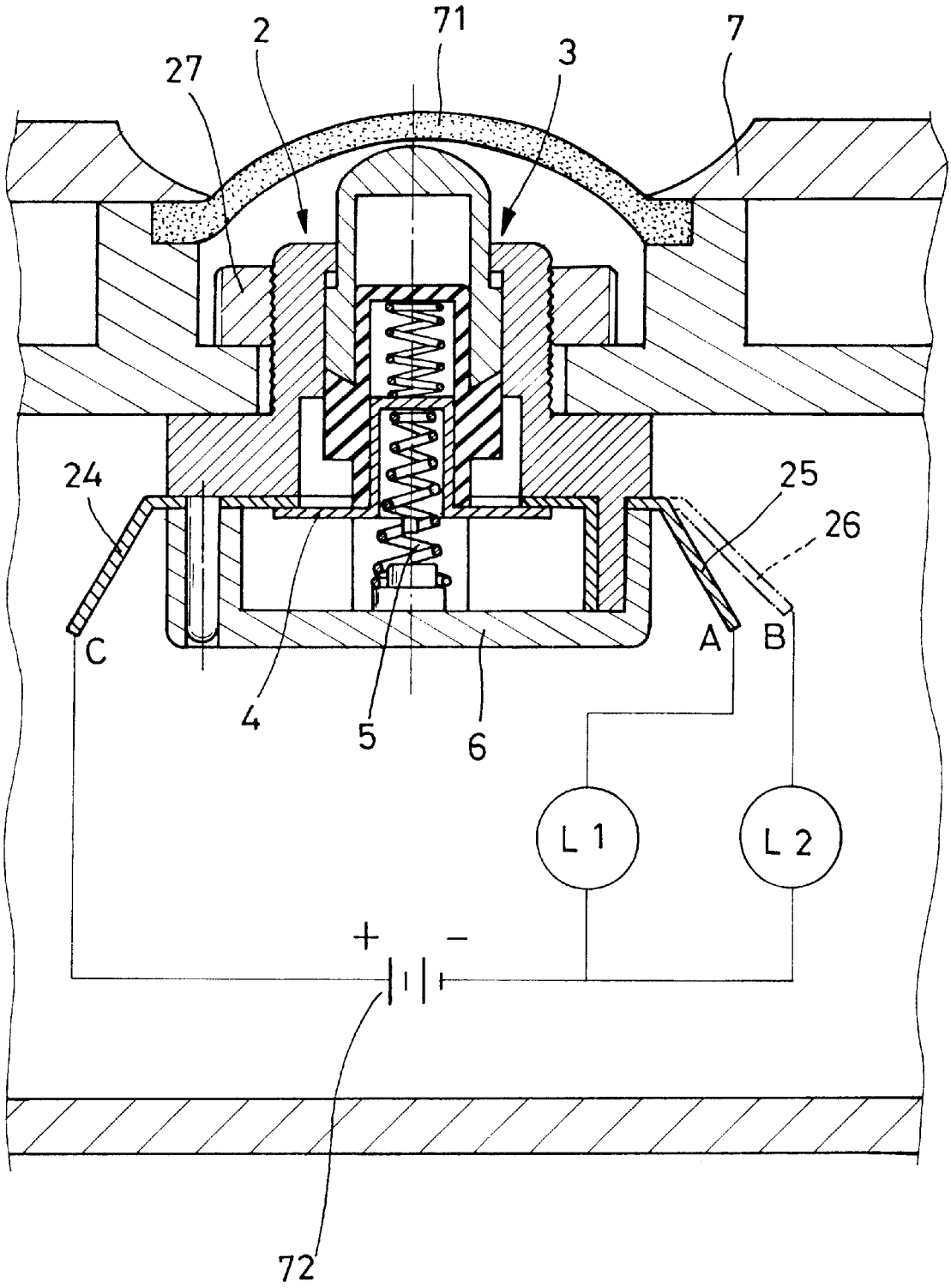
FIG. 9 is a sectional view showing an application example of the present invention.

FIG. 9 shows an application example of the present invention. As illustrated in FIG. 9, a lock nut 27 is fastened to the outer thread of the casing 2 to fixedly secure the switch to an object 7, a waterproof covering 71 is fastened to the object 7 to protect the switch against outside water without affecting the operation of the switch, and an electric circuit 72 is installed in the object 7 with its positive terminal connected to the first metal contact plate 24 and its negative terminal connected in parallel to the second metal contact plate 25 through a first lamp bulb L1 and the third metal contact plate 26 through a second lamp bulb L2. When the contacts C-A are electrically connected, the first lamp bulb L1 is turned on, when the contacts C-B are electrically connected, the second lamp bulb L2 is turned on and the first lamp bulb L1 is turned off, and when the contacts A-B-C are off, the first lamp bulb L1 and the second lamp bulb L2 are off. Therefore, only one press switch is sufficient to control two lamp bulbs L1;L2.

Further, the spring power of the spring 5 surpasses the spring power of the spring 33. Therefore, the peripheral lugs 421 of the metal conducting plate 4 are positively maintained in contact with the metal contacts 24;25 or 24;26 when switched to either of the two "on" positions (C-A and C-B).

A prototype of three-step switch has been constructed with the features of FIGS. from 3 through 9. The three-step switch functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A three-step press switch comprising a casing shaped like a stepped tube, said casing comprising a first receiving chamber and a second receiving chamber, said first receiving chamber comprising a plurality of longitudinal guide grooves equiangularly spaced around an inside wall thereof, said longitudinal guide grooves each having a beveled bottom side, an outer thread around the periphery of an upper part thereof, and a flange extended around the periphery of a middle part thereof;

an actuating device mounted in said first receiving chamber of said casing and forced to rotate through an angle when pressed, said actuating device comprised of a press member, a rotary member, and a spring, said press member being a hollow, bottom-open shell, comprising a plurality of longitudinal ribs spaced around the periphery of a lower part thereof and respectively coupled to the longitudinal guide grooves of said casing to guide vertical movement of said press member in said casing and a downwardly extended serrated bottom edge, said rotary member being a hollow, bottom-open shell, comprising a top insertion portion inserted into said press member from a bottom side, an upwardly extended serrated portion disposed around the periphery thereof on the middle and meshed with the serrated bottom edge of said press member, the spring of said actuating device being mounted in said rotary member to impart an upward pressure to said rotary member and said press member;

wherein said second receiving chamber of said casing comprises a plurality of three openings in the periphery thereof, three downward pins respectively suspending in said openings, a first metal contact plate coupled to one of said downward pins and disposed at one side of said casing, a second metal contact plate and a third metal contact plates disposed at one side of said casing opposite to said first metal contact plate and arranged at right angles; said rotary member comprises two downwardly extended driving rods adapted to rotate a metal conducting member below; the three-step press switch further comprises a bottom cover covered on a bottom side of said casing, a second spring mounted in said bottom cover, and a metal conducting member supported on said second spring and coupled to said rotary member for synchronous rotation with said rotary member relative to one of a series of positions including a first position where said first metal contact plate and said second metal contact plate and said third metal contact plate are electrically disconnected, a second position where said metal conducting plate is disposed in contact with said first metal contact plate and said second metal contact plate to electrically connect said first metal contact plate and said second metal contact plate, and a third position where said metal conducting plate is disposed in contact with said first metal contact plate and said third metal contact plate to electrically connect said first metal contact plate and said third metal contact plate, said metal conducting plate comprising a flat base supported on said second spring and an upright rod upwardly extended from the center of said flat base and inserted into said rotary member from a bottom side, said flat base comprising two peripheral lugs disposed at two sides and adapted to contact said first metal contact plate, said second metal contact plate and said third metal contact plate, and two peripheral notches respectively coupled to the downwardly extended driving rods of said rotary member for enabling said metal conducting member to be rotated with said rotary member when said press member is pressed by an external force.

* * * * *